US006855205B2

(12) United States Patent
McQuate et al.

(10) Patent No.: US 6,855,205 B2
(45) Date of Patent: Feb. 15, 2005

(54) APPARATUS FOR PLACING PARTICLES IN A PATTERN ONTO A SUBSTRATE

(75) Inventors: William M. McQuate, Denver, PA (US); Elizabeth A. Malkowski, Lancaster, PA (US); John J. Orlando, Macon, GA (US); David A. Kraft, Lancaster, PA (US)

(73) Assignee: AWI Licensing Company, Wilmington, DE (US)

( * ) Notice: Subject to any disclaimer, the term of this patent is extended or adjusted under 35 U.S.C. 154(b) by 0 days.

(21) Appl. No.: 10/354,605

(22) Filed: Jan. 30, 2003

(65) Prior Publication Data

US 2003/0170384 A1 Sep. 11, 2003

Related U.S. Application Data

(62) Division of application No. 09/839,081, filed on Apr. 20, 2001, now abandoned.

(51) Int. Cl.[7] ..... B05C 19/04
(52) U.S. Cl. ..... 118/301; 118/308
(58) Field of Search ..... 118/14, 19, 213, 118/301, 308, 406, 418; 101/123, 126, 127, 127.1; 427/180, 242, 282

(56) References Cited

U.S. PATENT DOCUMENTS

| | | | | | |
|---|---|---|---|---|---|
| 3,245,341 | A | * | 4/1966 | Childress et al. | 101/122 |
| 4,209,553 | A | * | 6/1980 | Greenberg | 427/179 |
| 4,604,966 | A | * | 8/1986 | Kohn | 118/406 |
| 4,675,216 | A | * | 6/1987 | DuForest et al. | 427/559 |
| 5,419,246 | A | * | 5/1995 | Bibby | 101/170 |
| 5,707,448 | A | * | 1/1998 | Cordera et al. | 118/13 |

* cited by examiner

*Primary Examiner*—Laura Edwards

(57) ABSTRACT

An apparatus for placing particles onto a substrate, methods for using the apparatus to deposit particles on a substrate and substrates prepared using the apparatus are disclosed. The apparatus includes a rotary screen, a blade disposed for directing and urging the particles through the screen, and a sheet mounted in a position to receive the particles from a feeder and deliver the particles to the rotary screen substantially across the blade. The apparatus can include a frame on which a rotary screen is rotatably mounted and a feed system disposed within and extending substantially along the length of the screen for distributing the particles. The apparatus can optionally include a vacuum means, an anti-static means and/or collection pans for handling stray particles. The screen can include a series of openings in the form of a pattern, and can be used to place particles in a pattern in register with a design or pattern on a substrate as the substrate passes under the openings in the screen.

15 Claims, 6 Drawing Sheets

APPARATUS FOR PLACING PARTICLES IN A PATTERN ONTO A SUBSTRATE

This application is a divisional of application Ser. No. 09/839,081 filed on Apr. 20, 2001, now abandoned.

FIELD OF THE INVENTION

This invention relates to the field of synthetic decorative coverings. More particularly, this invention relates to an apparatus and method for manufacturing synthetic decorative coverings.

BACKGROUND OF THE INVENTION

The manufacture of synthetic decorative coverings based on synthetic materials such as polyvinyl chloride (PVC), particularly for floors and walls, has been the subject of major developments in recent decades. These decorative coverings typically include a base material, for example, jute fibers, asbestos, non-woven glass fibers, synthetic foam and the like. A sheet or layer of PVC typically overlies the base. Finally, a desired decoration or pattern overlies the sheet or layer of PVC, which is usually protected by a transparent film covering or wear layer.

Several successive applications are typically carried out to produce the final decorative surface. The various components are typically applied using printing techniques. Each printing application generally requires a drying step, after which a transparent protective covering can be applied. In these printing processes, decorative components, commonly particles of a specific composition, are deposited through a rotary screen onto a substrate material.

Various apparatus have been developed to carry out these processes, for example, an apparatus is disclosed in German Patent No. 20 37 740 C3 to Knobel ("Knobel") and another disclosed in U.S. Pat. No. 4,675,216 to DuForest et al. ("DuForest"). The apparatus disclosed in Knobel includes a rotating stencil roller and a rotating counter-roller mounted in a machine frame. A substrate material passes between the two rollers while being simultaneously printed. The stencil roller is perforated, while the counter-roller is smooth. A feeder pipe with openings for decorative components to pass through is positioned inside the stencil roller, with a worm shaft with a gear or screw to push the decorative components through the feeder pipe. A distributor roller with several squeegee ridges on its surface runs parallel to the feeder pipe. The decorative components are distributed along the length of the feeder pipe, pass through the openings in the feeder pipe onto squeegee ridges and are deposited onto the substrate through the stencil roller.

The apparatus disclosed by DuForest generally includes a roller having a mesh screen, a feed screw for distributing decorative components, and a hopper having a pair of blades inside. The screw feeds the decorative components along the hopper, while the blades regulate the flow of the decorative components through the mesh screen.

It would be advantageous to provide an additional rotary screen for depositing particles on a substrate. The present invention provides such screens, as well as methods for using the screens to apply particles to a substrate, and substrates prepared with the apparatus.

SUMMARY OF THE INVENTION

An apparatus for depositing decorative components (particles) onto a substrate is disclosed. Methods for applying particles to a substrate using the apparatus, and surface coverings and surface covering components prepared using the methods are also disclosed.

The apparatus includes, at a minimum, a rotary screen, a blade that engages and exercises a slight pressure on the screen to urge and distribute particles through the screen, and a sheet that extends along substantially the entire width of the screen. The sheet, which in one embodiment is a flexible sheet, is in operable position to receive particles from a feed system.

The apparatus can also include a means for feeding particles to the screen ("feed system") and a means for holding and rotating the screen. The apparatus can optionally include a vacuum means to pick up stray particles and/or anti-static bars to control static.

The rotary screen is generally of a cylindrical shape and includes an internal chamber or passage. The screen can be rotatably mounted on a support frame or other suitable means for holding the screen, which can also include a means for rotating the screen. The screen includes a side wall with a series of perforations, which in one embodiment correspond to a desired pattern for depositing particles.

The feed system can be disposed inside and extend through the internal chamber of the rotary screen. Feed systems typically include a feeder pipe or other means for feeding particles through the length of the rotary screen. In one embodiment, the feed system is connected to an adjusting mechanism to control the amount of particles that are deposited on the substrate. A feeder receptacle or other means for holding particles and supplying them to the feeder pipe communicates with one end of the feed system, and can be used to supply particles to the feeder pipe. The feeder pipe also includes a worm gear or other means for moving particles along the feeder. The means for moving particles along the feeder are generally mounted within and extend along the feeder pipe.

The blade is mounted on a support structure, which in one embodiment is the feeder pipe, and engages and exercises a slight pressure on the rotary screen to urge and distribute particles through the rotary screen. The particles can be deposited on a substrate as it passes under the rotary screen.

The sheet is disposed within the internal chamber of the rotary screen in a position to catch particles distributed by the feeder pipe. The sheet, which can be flexible, is operably mounted to a frame such that it substantially maintains its position inside the screen while the screen is rotated. In one embodiment, as the screen is rotated, the sheet presses against the side wall of the screen. The particles accumulate on the flexible sheet and are distributed along the screen for deposition through the screen and onto the substrate. Particle deposition is further regulated by a separation gap or opening defined between the flexible sheet and the blade. Particle deposition along the length of the screen is more uniform using the flexible sheet than when the sheet is not used.

In operation, particles are fed through the feeder by the worm gear or similar means, and are deposited onto the sheet through the openings on the feeder. The particles are then deposited onto the screen, and, when pressed against the blade, fall through openings in the screen onto a substrate passing beneath the screen, as the screen rotates. The blade, flexible sheet and the size of the openings in the screen all control the amount of particles that are deposited.

In one embodiment, the particles are deposited on the substrate in register with a printed or embossed pattern on the substrate. Any excess particles that are retained on or in the perforations of the rotary screen can be removed, for example, using a vacuum removal system mounted adjacent the screen as the screen is rotated. Any static buildup can be removed using anti-static bars or other suitable means known in the art for removing static buildup.

Typically, a substrate to be coated with the particles is placed on a conveyer belt and passed under the screen. The particles are deposited on the substrate, in one embodiment in register with a printed or embossed pattern. The particles can then be fused, for example, by applying heat to the particle-coated substrate to provide materials useful as surface coverings and/or as surface covering components.

Surface coverings and surface covering components that include a substrate and a particle layer overlying the substrate can be prepared using the apparatus. In one embodiment, a plastisol layer, adhesive layer or other suitable layer overlies the substrate in such a manner that the particles can adhere to the layer after they are deposited on the substrate. The particles can be consolidated by applying a suitable amount of heat. In one embodiment, a wear layer can be applied over the particle layer. One or more foamable layers can overly the substrate, and these optionally can be foamed at or around the same time the particles can be fused, if required. One or more of the foamable layers can be chemically embossed, for example, in register with a pattern of foaming inhibitors or promoters. The surface covering can be mechanically embossed, and can also include a printed pattern or design.

In another embodiment, the apparatus includes a blade rotatably mounted on a frame, and a rotary screen attached to the frame, where the apparatus does not include a sheet.

Various features, objects and advantages of the present invention will become apparent upon reading and understanding this specification, read in conjunction with the appended drawings.

DETAILED DESCRIPTION

Figure 1:
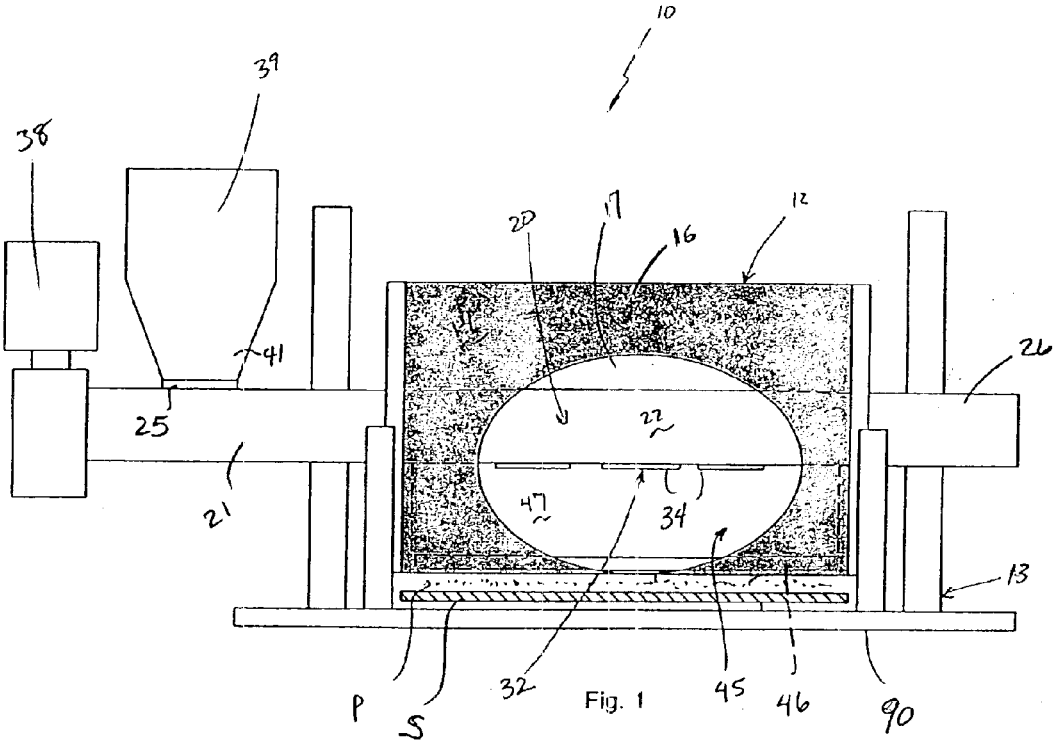
FIG. 1 is a side elevational view of an apparatus for depositing particles, as described herein, taken in partial cross section.

An apparatus for depositing decorative components (particles) onto a substrate is disclosed. The apparatus can be used to manufacture synthetic decorative coverings such as floor or wall coverings, floor tiles and the like, as well as components for use in preparing such coverings. Methods for applying particles to a substrate and surface coverings and surface covering components prepared using the methods are also disclosed.

Apparatus

The apparatus includes, at a minimum, a rotary screen, a blade that engages and exercises a slight pressure on the screen to urge and distribute particles through the screen, and a sheet that extends along substantially the entire width of the screen. The sheet, which in one embodiment is a flexible sheet, is in operable position to receive particles from a feed system.

The apparatus can also include a means for feeding particles to the screen ("feed system") and a means for holding and rotating the screen. The apparatus can optionally include a vacuum means to pick up stray particles and/or anti-static bars to control static.

Rotary Screen

The rotary screen includes a series of perforations that permit particles to flow from inside the screen down onto a substrate. The rotary screen is typically a metal screen or mesh, although other substantially rigid, durable materials also can be used. Examples of other materials include high-strength plastic and other synthetic materials.

The rotary screen is generally in the shape of a cylinder, although other shapes can be used if desired. The screen includes an interior chamber and a perforated screen wall or side wall with a series of openings or perforations for particles to pass through. Although not necessary, the perforations can be arranged in the screen wall of the rotary screen in a desired pattern or design for applying or depositing the particles onto a substrate in a desired pattern or design. In one embodiment, the particles can be added to the substrate in register with a design on the substrate by moving the substrate and rotating the rotary screen in concert.

Particle Feeding System

The rotary screen includes at least one open end through which particles can be introduced. The particles are passed through a feed system that supplies the particles to the interior chamber of the rotary screen. Any means for introducing the particles along the width of the screen can be used. In one embodiment, the particles are introduced along the width using a feeder pipe.

Feeder pipes include a body or tube that extends substantially longitudinally, approximately through the center of the interior cavity of the rotary screen. The body of the feeder pipe is generally substantially cylindrical, although other configurations or shapes can also be used if so desired. The feeder pipe includes a side wall that defines an interior passage or channel that extends longitudinally through the body of the feeder pipe, and a first, inlet end and a second, exhaust or outlet end.

Various means can be used to move particles through the feeder pipe along the length of the screen. Examples of particle-moving means include worm gears and travel screws with helical blades or vanes extending about a core or drive shaft. The particle-moving means is received within and extends along the internal passage of the screen and/or feeder pipe. The helically-extending vane or blade can be equipped with a series of brushes or bristles positioned in spaced series along the edges of the vanes to engage the side wall of the feeder pipe as the drive shaft is rotated. This engages and urges the particles along the length of the feeder pipe. The particles are then distributed along the feeder pipe for distribution and deposition across the width of the screen, where they first can be deposited on the flexible sheet by gravity, and later pass from the sheet onto the screen.

Motors are typically connected to a drive shaft on the worm gear to drive the worm gear, cause the worm gear to rotate, and urge or push the particles along the feeder pipe. In one embodiment, the motor is an electric motor, although other types of motors, such as hydraulic motors or other drive systems as known in the art also can be used.

There can be a series of ports in the side wall of the feeder pipe, arranged at spaced locations along an intermediate portion of the length of the feeder pipe within the interior cavity of the rotary screen. The ports can be used to deposit particles across the width of the rotary screen. The number of ports is typically between 3–5 ports, although a greater or lesser number of ports can be used as desired. The ports are generally formed as a cutout in the side wall of the feeder pipe, defining a port opening in the pipe. The size of the opening can be varied to control the particle distribution. Covers or shutters can be placed over the ports to adjust the size of the port openings. This enables greater or lesser amounts of particles to fall through the ports.

The shutters can be formed using any suitable material, and are generally formed from a metal or plastic material, such as a metal foil. The shutters are typically mounted on a movable slide mechanism that can be moved longitudinally along the length of the feeder pipe to open and close the port openings. The shutters can be mounted on a single slide plate or mounted on separate plates, with the shutters either fixed in position or adjustable. The shutters are moved longitudinally along the body of the feeder pipe and can enlarge or shrink the size of the port opening. Typically, the port openings at the inlet or first end of the feeder pipe are closed off to a greater degree than the openings adjacent the second, exhaust or outlet end of the feeder pipe. This helps ensure that the particles are substantially evenly distributed across the width of the rotary screen instead of being bunched or concentrated at only one area or location on the rotary screen.

A feed receptacle or other suitable particle-holding means is typically attached to the feeder pipe adjacent the inlet end. The receptacle generally is a container or bin with an inwardly sloping lower portion, and supplies particles into the feeder pipe. The particles are urged or pushed along the body of the feeder pipe by operating the worm gear, and are correspondingly distributed across the flexible sheet on the interior chamber of the rotary screen for ultimate deposition onto a substrate.

Means for Holding and Rotating the Screen

In use, the screen is rotatably mounted onto a frame that holds the screen and allows it to rotate, wherein the screen can deliver particles to a substrate lying or passing underneath the screen. In one embodiment, the frame is adjustable. Any suitable frame that can hold the screen and permit it to rotate can be used. Such frames are well known in the art, and include those described in U.S. Pat. No. 4,675,216 to DuForest et al., the contents of which are hereby incorporated by reference.

In one embodiment, the screen is releasably mounted onto the frame. In this embodiment, different rotary screens with different perforation patterns or designs can be substituted on the frame, which enables formation of different decorative patterns on the substrate. If the screen is releasably mounted onto the frame, the frame and screen must include suitable means for such releasable attachment. Such means are well known to those of skill in the art. In one embodiment, rods on both ends of the screen fit in appropriately positioned U-shaped grooves on the frame.

The pattern or the design of the perforations in the rotary screen can also be changed or otherwise modified without requiring a compete change out of the rotary screen. This can be accomplished, for example, by applying a patterned film or covering on the outside or inside of the rotary screen.

In one embodiment, the frame includes a means for rotating the screen. This means can include a motor and a chain or other means that rotates the screen in concert with the movement of the motor. The screen must be adapted for use with the means for rotating the screen. For example, when a chain is used to turn the screen, the screen must include a suitable means for attaching the chain. Such means are well known to those of skill in the art.

Blade

A blade assembly is mounted beneath the particle feeding system slightly behind or off-center relative to the feeder pipe. The blade assembly includes a blade, which can be formed from any suitable rigid, durable high-strength material. Examples of suitable materials include high density polyethylene, metals and other durable materials. The blade is generally attached to a guide or support that is mounted to the feeder pipe and extends downward in the direction of the substrate to which the particles are to be applied. The blade is generally positioned below and downstream from the point at which the ports of the feeder pipe deposit or distribute the particles onto a flexible sheet. Accordingly, the particles tend to accumulate against and spread out along the length of the blade. This urges the particles through the screen wall of the rotary screen. Typically, the blade is mounted or adjusted downwardly toward the screen wall of the rotary screen so as to engage and apply a slight pressure against the screen. The pressure applied by the blade can be adjusted, depending upon the thickness of the screen and the size and shape of the particles. Such adjustments can help urge the particles through the perforations in the rotary screen and avoid getting an uneven lay-up or accumulation of material along the rotary screen. This is particularly relevant at areas where there are no pattern perforations in the rotary screen. The engagement of the blade against the screen wall of the rotary screen should not cause deformation or otherwise damage the rotary screen.

Figure 2:
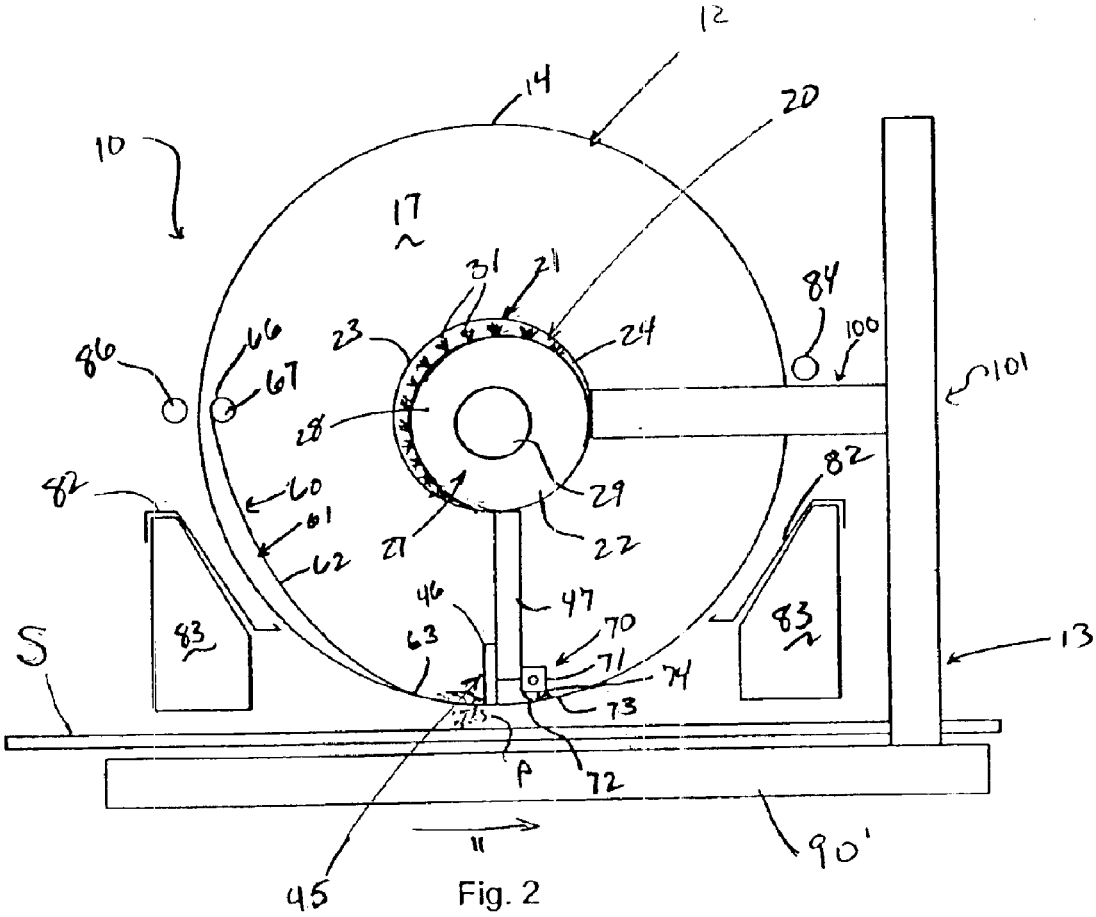
FIG. 2 is an end view of the apparatus for depositing particles as described herein.
Figure 5:
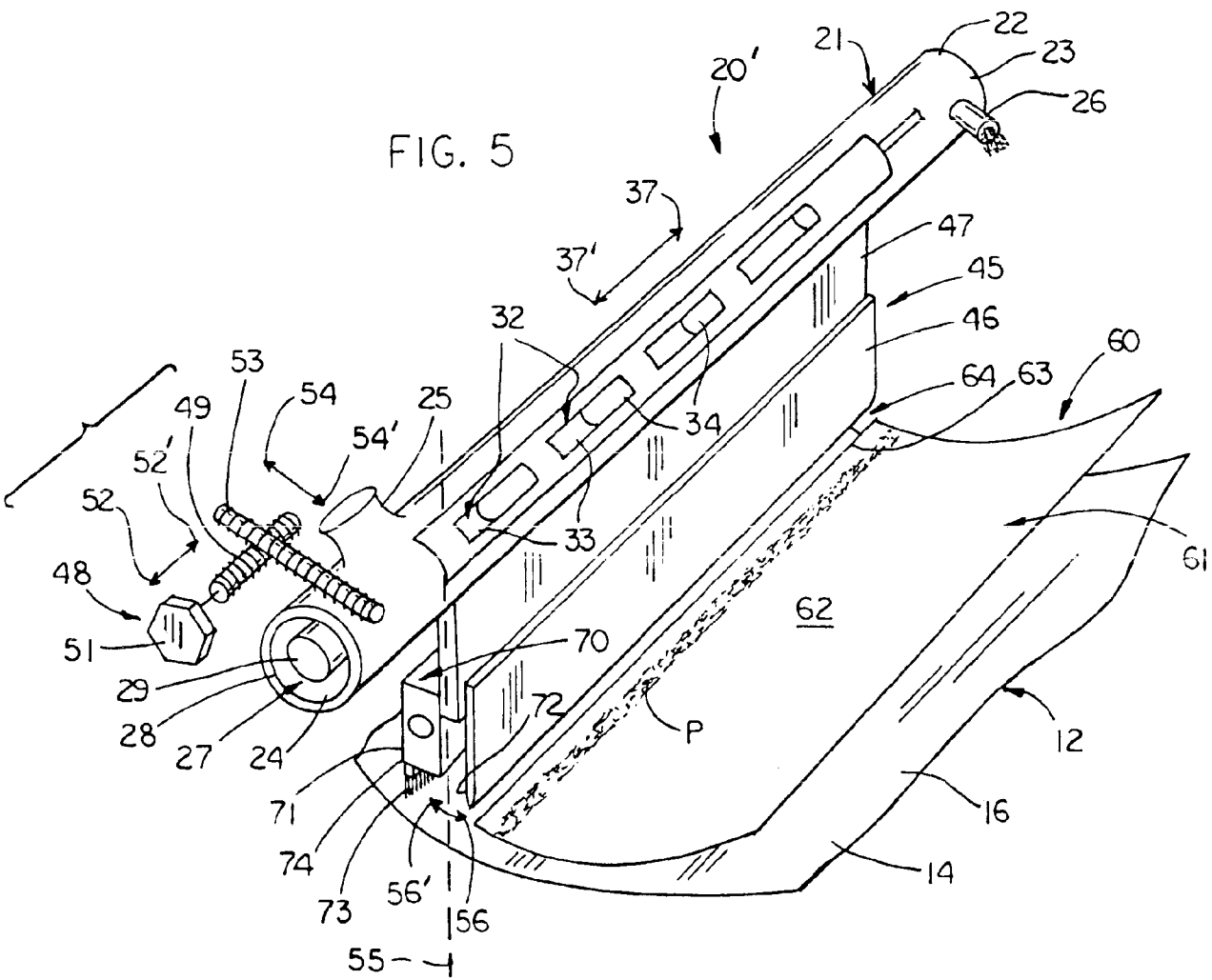
FIG. 5 is a perspective view of the feed system and adjustment mechanism for the feed system and blade in one embodiment of the apparatus described herein.

In those embodiments where the blade is attached to a feeder pipe, the blade can be adjusted with respect to the screen wall to move the blade into engagement with the screen wall by adjusting the position of the feeder pipe using an appropriate adjustment mechanism. In FIG. 2, the feeder pipe assembly is attached to mounting bar 100 which can be raised or lowered to adjust the vertical position and pressure of blade on the rotary screen. The mounting bar 100 holding the feedpipe/blade assembly is also mounted onto support bar 101, which can also be moved horizontally to position the blade assembly within the rotary screen. Additionally, the adjustment mechanism illustrated in FIG. 5 includes a worm gear or travel screw connected to and moved by a motor handcrank or similar adjustment mechanism to cause the travel screw to move. As shown in FIG. 5, the direction of the movement follows arrows 52 and 52'. The travel screw engages a crosswise or transversely extending worm gear or travel screw connected to the feeder pipe. As the travel screw is rotated and moved in the direction of arrows 52 and 52', the travel screw or worm gear rotates and moves in the direction of arrows 54 and 54' as shown in FIG. 5. The feeder pipe then pivots toward or away from a vertical centerline, indicated by dashed lines 55 in FIG. 5, with respect to the screen wall of the rotary screen. As the feeder pipe is rotated, the blade 46 is accordingly pivoted in the directions of arrows 56 and 56' in FIG. 5 to move the blade into or out of engagement with the screen wall to adjust the pressure being applied against the rotary screen by the blade.

Those skilled in the art will understand that other types of adjustment mechanisms also can be used, including adjustably mounting the blade on the blade support so that the blade can be moved vertically with respect to the support and secured or otherwise locked in place. Additionally, the whole feeder assembly can be mounted on the frame and accordingly can be adjusted vertically along the frame with respect to the rotary screen to bring the blade into more or less engaging contact with the rotary screen. Further, the position of the rotary screen itself can be adjusted on the frame to bring the blade into engagement with and place pressure on the screen wall.

Sheet

The sheet is mounted within the interior chamber of the rotary screen, although it is not attached directly to the screen, in a position to receive and collect or accumulate particles from the feeding system or other particle depositing means. The sheet can disperse the particles to the screen perforations of the rotary screen. The sheet can be flexible, and is typically formed from a durable, flexible polymeric material. Examples of suitable polymeric materials include 40 mil high density polyethylene, nylon, or other plastic materials, as well as various metals.

The sheet advantageously has a sufficient thickness and strength to engage and bear against the interior of the screen wall of the rotary screen and maintain a tight contact with the screen. The sheet generally includes a sheet body with a width approximately equal to at least the patterned area of the perforations of the rotary screen. The sheet includes a first or proximal end that engages and bears against the interior of the screen wall of the rotary screen and which terminates and is separated from the blade by a variable gap. The sheet also includes a second or fixed end attached to a mounting or sheet holding device, which device may be within the interior cavity of the rotary screen.

The sheet holding device secures the second or fixed end of the flexible sheet and is generally rotatable. In one embodiment, the sheet holding device is attached to the same frame that the screen and/or the feeder pipe are attached to. As the sheet holding device is rotated in a clockwise direction, the flexible sheet is urged into further, tighter engaging contact with the screen wall of the rotary screen. This in turn causes the first end of the flexible sheet to retract from the blade and increase the gap between the blade and the sheet. As the sheet holding device is rotated in a counter-clockwise direction, the second end of the sheet is urged toward the screen wall of the rotary screen. This causes the first end of the flexible sheet to slide along the screen wall closer toward the blade so as to narrow the gap between the blade and the sheet. Adjusting the flexible sheet enables one to adjust the gap between the blade and the first or proximal end of the flexible sheet. This permits greater or lesser amounts of particles to be fed through the perforations of the rotary screen as the gap is widened and lessened as needed or desired for depositing a particular pattern or design on the substrate.

Vacuum Device

Figure 3:
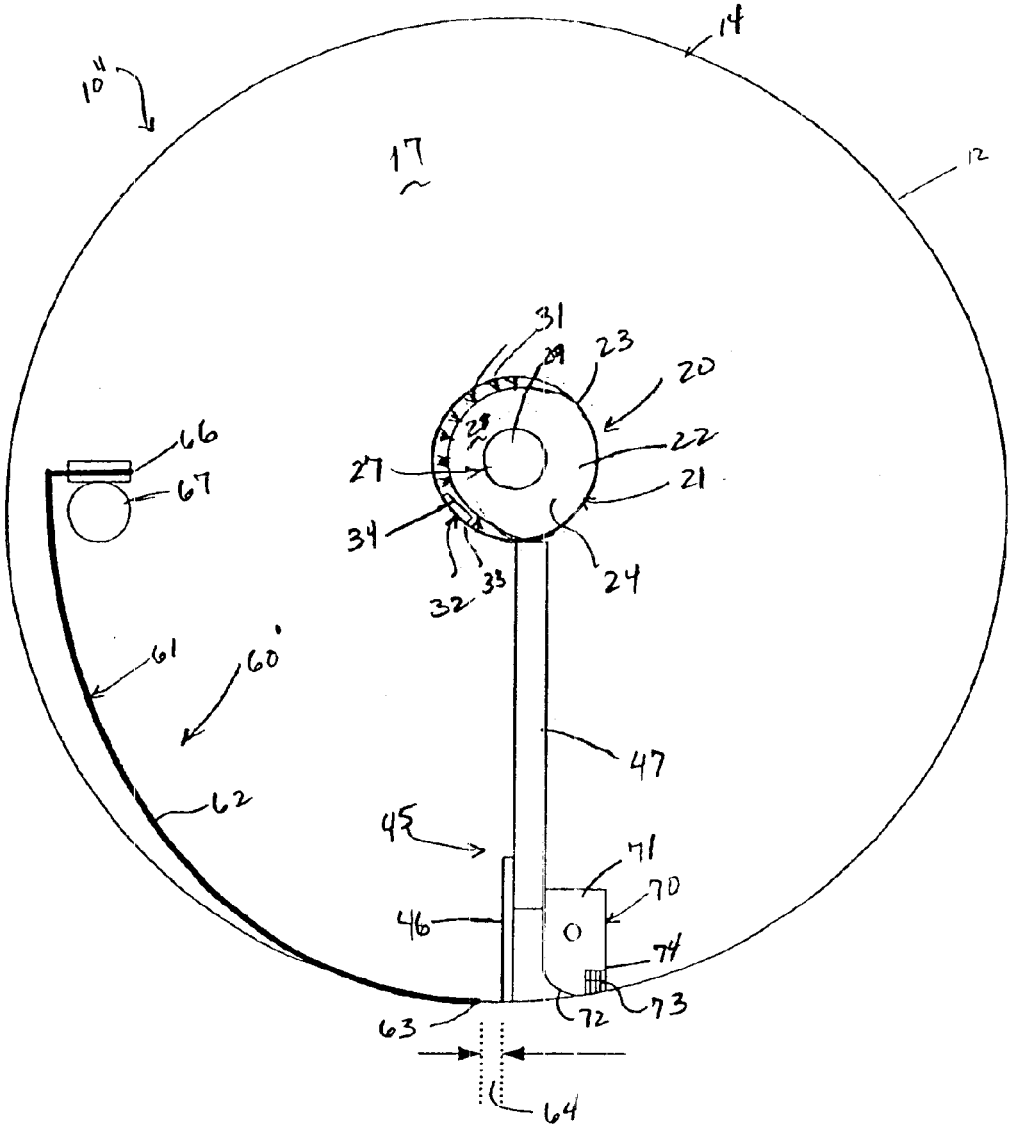
FIG. 3 is an end view illustrating in greater detail the separation defined between the flexible sheet and the blade in one embodiment of the apparatus described herein.

As shown in FIGS. 2, 3, and 5, a vacuum assembly or system can optionally be mounted to the blade support, typically on the opposite side from the blade. Vacuum assemblies are well known to those of skill in the art. The vacuum assembly generally includes a manifold connected to a vacuum or suction source that is open along its lower surface. The manifold can alternatively be mounted on an adjustable rod or frame to enable further adjustment of the manifold with respect to the screen wall of the rotary screen. The manifold generally includes a leading bottom edge that engages and bears against the screen wall of the rotary screen. A series of brushes and bristles can be mounted along the trailing edge of the manifold in a position to further engage and sweep any loose particles that remain on the rotary screen back toward the center opening of the manifold. A vacuum or suction can be applied through the opening in the manifold to create a negative pressure within the manifold and draw in any particles that pass under the blade assembly without being passed or urged through the perforations of the rotary screen. The particles can then be collected and recycled. It will also be understood that other types of particulate removal systems also can be used in place of the vacuum system for removing excess, unused particles from the rotary screen.

Collection Pans

Collection pans or other suitable means for collecting stray particles can be used to accumulate particles that pass through the screen but would otherwise be deposited on the substrate in undesired locations. They are advantageously placed above the substrate to be coated, on either side of the desired particle deposition zone (i.e., on the upstream and downstream sides of the rotary screen).

Each of the collection pans generally includes a sloped plate that extends downwardly at an angle toward the screen wall of the rotary screen. In one embodiment, the plates are each adjustably mounted on a support to enable the position of the plate to be adjusted with respect to the screen wall of the rotary screen as needed. This insures that the collection pans will be in a desired or necessary position for optimal collection of any particles that remain trapped on the rotary screen that were not previously collected by the vacuum assembly, if one is used.

Means for Removing Static Buildup

Ionizing or anti-static bars, or other suitable means for removing static buildup on the rotary screen, can optionally be positioned along the upstream and/or downstream sides of the rotary screen adjacent the outer surface of the screen wall. In one embodiment, they are placed above the collection pans. The ionization or anti-static bars tend to ionize the particles remaining on the rotary screen so as to substantially remove electrostatic charges on the screen that would cause the particles to stay attached to the screen wall. As a result, the particles are released from the screen wall and are allowed to drop and be collected by the collection pans and subsequently removed and re-cycled.

Particles

Any particles that can be deposited on a substrate and can pass through the perforations in the screen can be used in the apparatus and methods described herein. The apparatus and methods described herein are not and should not be limited to use with only particular types of substrates and/or particles and/or particular types of surface coverings.

Examples of suitable particles include chips, filled and/or unfilled pieces or granules, typically of a decorative plastic material such as PVC or other polymeric materials. The particles can be in various colors and/or can include reflective foils or other, similar decorative materials. The particles can be present in a variety of shapes, to provide a decorative appearance or pattern on the substrate. It will be further understood by those skilled in the art that various types of particles and substrates can be used to form decorative coverings.

Surface Coverings and Surface Covering Components

Surface coverings and surface covering components that include the particle-coated substrates described herein include floor coverings, wall and ceiling coverings, countertops, and laminates. Examples include wallpaper, vinyl floors and the like.

Such substrates are well known in the art, and can include layers such as felt backing materials, encapsulated glass mats, plastisol films, foams, transparent films, hot-melt calendared layers (for example, of a polyvinyl chloride, polyolefin or other thermoplastic polymers), randomly dispersed vinyl particles, stencil disposed vinyl particles, and the like. The selection of these materials is within the skill of an ordinary artisan. The thickness of such substrates is typically, but not necessarily, in the range of 40 to 100 mils.

Typically, the substrate will include a base material formed from, for example, jute, glass fiber, synthetic foam, plastic sheets, or other materials as conventionally known in the art, over which a layer or sheet of a polymeric material such as a polyvinylchloride ("PVC"), or a plastisol or fluid material typically is applied. The substrate can also be imprinted with a rotogravure or printed pattern.

In one embodiment, the surface covering substrate includes one or more foamable layers, one or more of which can be a chemically embossed layer formed before or after the particles are applied. This type of layer is typically applied as a foamable gel, and the gel can include foaming agents and/or foaming promoters. The thickness of the gel layer is typically, but not necessarily, in the range of 6 to 20 mils in an un-blown state, and between 12 and 60 mils when blown ("cured"). The foaming agents and/or, promoters can be present in the gel layer and/or present in a printed pattern in an adjacent layer to the gel layer. Inhibitors can be applied in selected areas to inhibit foaming in such areas. Printed pattern layers are typically less than one mil in thickness when applied using a rotogravure process, or one mil or greater when applied using a screen process. Such agents provide chemical embossing in register with the agents, where the foamed portion corresponds to the presence of the foaming agent and/or promoter, and the un-foamed portion corresponds to the absence of the foaming agent and/or the presence of a foaming inhibitor. Typically, the foaming is done by subjecting the foamable layer to elevated temperatures, for example, in the range of 120 to 250° C., in one embodiment, between 180 and 250° C., for between 0.5 and 10 minutes.

In one embodiment, the substrate includes a layer of a material to which the particles adhere or sink into after they are deposited onto the substrate. Examples of suitable materials include PVC plastisols before they are cured, plasticizers, particularly when the particles include PVC, melt adhesives, including hot melts and EB or UV curable melts, and contact adhesives, for example, epoxy resins, and moisture curable materials such as urethanes and isocyanates. The particles can be retained in place on the substrate using these materials. The materials can also help protect any print layers during processing, and protect the foam layers during consolidation and further processing. The materials further can improve the key between the substrate and an HMC clear film, if one is applied.

A clear wear layer can be but is not necessarily applied over the particle layer, typically but not necessarily with a thickness of between 10 and 20 mils. Such layers are commonly formed of a material that includes a PVC plastisol. A top coat layer can also be applied. Additionally, the wear layer or wearlayer/top coat can also be mechanically embossed to enhance the visual, if desired. Top coat layers, including those formed from UV-curable compositions, are well known in the art.

Surface covering components can be prepared that include a particle layer and optionally include one or more additional layers, where the particle layer is attached to a releasable sheet. The resulting component can be laminated or processed with other substrates to produce a surface covering.

In one embodiment, the surface covering or surface covering substrate may be mechanically embossed before or after the particles are applied.

Method of Passing Particles Through the Screen

In use, particles are passed from a receptacle or other particle-holding means through a feeder pipe or other particle-moving means along the inside of the rotary screen. The particles pass through holes in the feeder pipe onto the flexible sheet, where they next pass onto the screen. When the particles are pressed against the blade, they are urged through the screen, onto a substrate that is passing under the screen.

The apparatus described herein, examples of which are shown in FIGS. 1 and 2, can be used to prepare surface coverings and surface covering components that include a substrate coated with particles as they pass through the apparatus. In one embodiment, a substrate is moved along a conveyor or table underneath a rotary screen. The screen includes a screen wall that includes a series of perforations or openings that can be formed or arranged in a desired pattern or design. In one embodiment, the pattern or design corresponds to a printed or embossed design or pattern formed on the substrate. As the substrate passes beneath the rotary screen, the screen is rotated so that the pattern is moved in timed sequence with the movement of the substrate. Methods for moving a rotary screen and a substrate underlying the screen in concert are well known in the art. As the rotary screen is rotated, a feed system deposits a supply of decorative particles into the inner chamber of the rotary screen.

As the perforations in the rotary screen pass beneath the blade, the particles are urged through the perforations of the screen and on to the substrate, in one embodiment, substantially in register with a printed or embossed pattern on the substrate.

In one embodiment, the substrate includes a wet plastisol coating, hot melt adhesive or thin wear layer in which the decorative chips or particles are deposited so that the chips or particles are deposited and absorbed into or adhere to the coating, adhesive or film wear layer. Thereafter, the substrate with the particles and/or chips deposited on it can be heated and cured, typically at a temperature of about 300° F., to form a fused particle layer on the substrate. The heating and curing can be performed, for example, by passing the materials through radiant heaters or other types of curing ovens or systems, as known in the art. If desired, additional layers can be formed on top of the fused particle layer.

The present invention will be better understood with reference to the following non-limiting examples.

EXAMPLE 1

Representative Apparatus

An example of a suitable apparatus as described herein is shown, for example, in FIGS. 1–3. In these and the other figures, like numerals indicate like parts throughout the several views. FIGS. 1–3 generally illustrate an applicator system or apparatus (10, 10' and 10", respectively) for depositing or applying particles onto a substrate. The particles are indicated at "P" and the substrate is indicated at "S" in FIG. 1.

As shown in FIG. 1, the apparatus 10 includes a rotary screen 12 that is rotatably mounted on an adjustable frame 13 and underneath which the substrate S is moved in the direction of arrow 11 (FIG. 2) for applying decorative particles. Screen 12 includes a perforated screen wall or side wall 14 with a series of openings or perforations 16 (FIG. 1). These openings enable passage of decorative particles (FIG. 1), and define an interior chamber or passage 17.

As illustrated in FIGS. 1–4, the apparatus 10 includes a feed system or assembly 20 adjustably mounted on the frame 13 that supplies the particles to the interior chamber 17 of screen 12. The feed system 20 includes a feeder pipe 21 with a body or tube 22 that extends substantially longitudinally, approximately through the center of the interior chamber 17 of screen 12 as indicated in FIGS. 1–3. The body 22 of feeder pipe 21 is substantially cylindrical and includes a side wall 23 that defines an interior passage or channel 24 that extends longitudinally through the body 22 of the feeder pipe, a first, inlet end 25 and a second, exhaust or outlet end 26.

Figure 4:
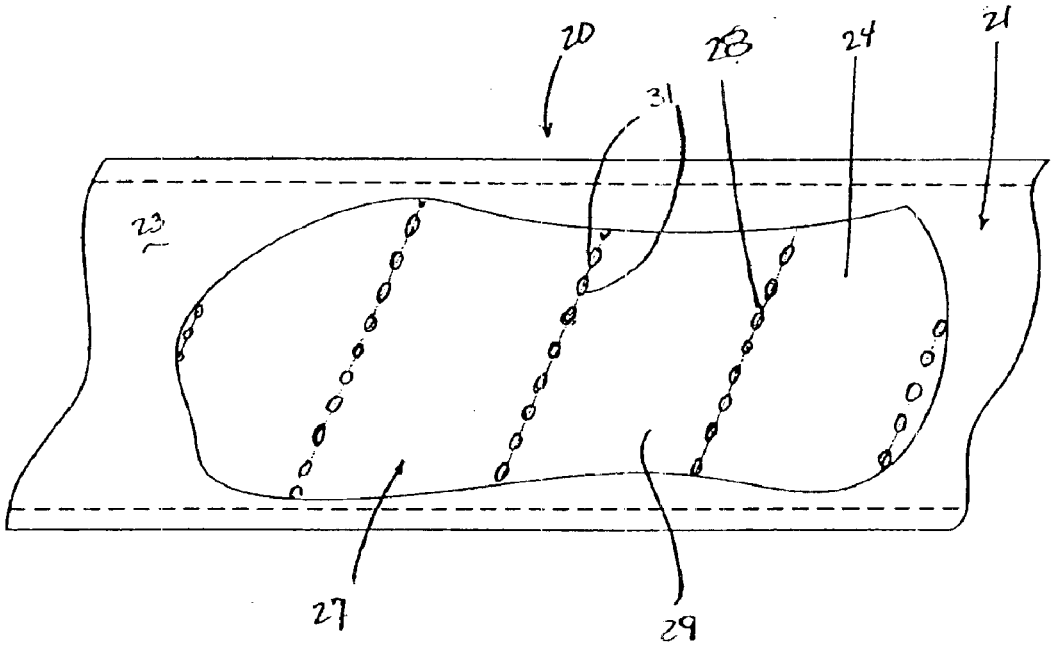
FIG. 4 is a cross sectional view of a portion of the worm gear of the feed system in one embodiment of the apparatus described herein.

A distribution mechanism, here illustrated as a worm gear or travel screw 27 having a helical blade or vane 28 extending about a core or drive shaft 29, is received within and extends along the internal passage 24 of feeder pipe 21. As illustrated in FIG. 4, the helically extending vane or blade 28 of the worm gear or screw 27 is equipped with a series of brushes or bristles 31 positioned in spaced series along the edges of vanes 28. The brushes or bristles 31 engage the side wall 23 of feeder pipe 21 as the drive shaft 29 is rotated to engage and urge the particles along the length of the feeder pipe. As a result, the particles are distributed along feeder pipe 21 for distribution and deposition across the width of screen 12, as indicated in FIG. 1.

As further illustrated in FIGS. 1 and 5, a series of ports 32 are formed in the side wall 23 of feeder pipe 21. The ports are arranged at spaced locations along an intermediate portion of the length of feeder pipe 21 within the interior cavity 17 of screen 12. The ports define a port opening 33 in feeder pipe 21. Covers or shutters 34 are provided across each of the ports 32 for adjusting the size of the port openings 33 to enable greater or lesser amounts of particles to fall through the ports.

The shutters are mounted on a movable slide mechanism 36, which can be moved longitudinally along the length of feeder pipe 21 for opening and closing off port opening 33. In the embodiment shown in FIG. 5, the shutters are mounted onto a single slide plate and can be moved longitudinally along the body of feeder pipe 21 in the direction of arrows 37 and 37' (FIG. 5) to enlarge or shorten the size of port opening 33 as desired. In this embodiment, port openings 33 at the inlet or first end 25 of feeder pipe 21 are closed off to a greater degree than the openings adjacent the second, exhaust or outlet end 26 of the feeder pipe. This helps ensure that the particles will be substantially evenly distributed across the width of screen 12 instead of being bunched or concentrated at only one area or location on the screen.

In the embodiment shown in FIG. 1, a motor 38 is connected to the drive shaft 29 of worm gear 27 to drive the worm gear and cause the worm gear to rotate to urge or push the particles along feeder pipe 21. A receptacle 39 is attached to feeder pipe 21 adjacent the inlet end 25. Receptacle 39 includes an inwardly sloping lower portion 41 and supplies particles into the feeder pipe. The particles are urged or pushed along the body 22 of feeder pipe 21 by operating worm gear 27. The particles are correspondingly distributed across the interior chamber 17 of screen 12. As shown in the embodiments shown in FIGS. 1 and 2, the particles can then be deposited onto a substrate passing beneath screen 12.

As shown in FIGS. 2, 3 and 5, a blade assembly 45 is mounted beneath feeder pipe 21 slightly behind or off-center with the feeder pipe. Blade assembly 45 includes a blade 46 that is attached to a guide or support 47 mounted to feeder pipe 21 and extending downward. Blade 46 is positioned below and downstream from the point at which ports 32 of feeder pipe 21 deposit or distribute the particles. The particles tend to accumulate against and spread out along the length of blade 46 for urging the particles through screen wall 14 of screen 12, as indicated in FIGS. 1, 2 and 5.

Blade 46 is adjustable with respect to screen wall 14 by adjusting the whole feeder assembly using mounting bar 100 on the frame 13 (FIG. 2). Mounting bar 100 can be adjusted vertically along the frame with respect to screen 12 to bring blade 46 into more or less engaging contact with screen 12. In addition, the position of screen 12 itself can be adjusted on the frame to bring blade 46 into engagement with and place pressure on the screen wall. Mounting bar 100 can also be moved horizontally to position the blade assembly within the rotary screen.

Additional adjustment can also be made to the feeder pipe 21 using an adjustment mechanism 48. The adjustment mechanism 48 as illustrated in FIG. 5 includes a worm gear or travel screw 49 connected to and moved by a motor, handcrank or similar adjustment mechanism 51. This causes the travel screw 49 to move in the direction of arrows 52 and 52'. The travel screw 49 engages a crosswise or transversely extending worm gear or travel screw 53 connected to feeder pipe 21. As the travel screw 49 is rotated and moved in the direction of arrows 52 and 52', the travel screw or worm gear 53 likewise rotates and moves in the direction of arrows 54 and 54'. This in turn causes the feeder pipe to be pivoted toward or away from a vertical center line, indicated by dashed lines 55, with respect to the screen wall of screen 12. As the feeder pipe rotates, blade 46 is pivoted in the directions of arrow 56 and 56' to move the blade into or out of engagement with the screen wall to adjust the pressure being applied against screen 12 by the blade.

As shown in FIGS. 2 and 3, a collector 60 is mounted within the interior chamber 17 of screen 12 in a position to receive and collect or accumulate particles. The particles can be dispersed through the screen perforations of screen 12. The collector 60 includes a flexible sheet 61 that engages and bears against the interior of screen wall 14 in tight contact with screen 12. Flexible sheet 61 includes a sheet body 62 with a width approximately equal to at least the patterned area of the perforations of screen 12. Sheet 61 also includes a first or proximal end 63 that engages and bears against the interior of screen wall 14. Sheet 61 terminates and is separated from blade 46 by a variable gap indicated by 64, and a second or fixed end 66 attached to a mounting or sheet holding device 67 within the interior cavity 17 of screen 12.

Sheet holding device 67 secures the second or fixed end of the sheet 61 and is rotatable such that as sheet holding device 67 is rotated in a clockwise direction, sheet 61 is urged into further, tighter engaging contact with screen wall 14. This causes the first end 63 of sheet 61 to retract from blade 46 to increase the gap 64 between the sheet and the blade. As sheet holding device 67 is rotated in a counterclockwise direction, the second end 66 of sheet 61 is urged toward screen wall 14. This causes the first end 63 of sheet 61 to slide along the screen wall closer toward blade 46 so as to narrow the gap 64 between the blade and the sheet. Adjustment of sheet 61 enables the corresponding adjustment of the gap 64 between blade 46 and first or proximal end of sheet 61. This enables greater or lesser amounts of particles to be fed through the perforations of screen 12 as the gap is widened and narrowed as needed or desired for depositing a particular pattern or design on the substrate.

As indicated in FIGS. 2, 3, and 5, a vacuum assembly or system 70 is mounted to the blade support 47 on the opposite side from blade 46. The vacuum assembly includes a manifold 71 connected to a vacuum or suction source (not shown) which is open along its lower surface. Manifold 71 further can be mounted on an adjustable rod or frame for enabling further adjustment of the manifold with respect to screen wall 14. Manifold 71 includes a leading bottom edge 72 that engages and bears against screen wall 14. A series of brushes and bristles 73 are mounted along the trailing edge 74 of manifold 71 in a position to further engage and tend to sweep any loose particles that remain on screen 12 back toward the center opening of the manifold. Vacuum or suction is applied through the opening in manifold 71 to create a negative pressure within manifold 71 and thus draw in any particles that pass under blade assembly 45 without being passed or urged through the perforations of screen 12. These particles can be collected and recycled.

Collection pans 82 are mounted on the upstream and downstream sides of screen 12. Each of the collection pans 82 include a slope that extends downwardly at an angle toward the screen wall of screen 12 (FIG. 2) and are each adjustably mounted on the screen saddle support 83 to enable the position of plates 82 to be adjusted with respect to the screen wall of screen 12 as needed. This ensures that collection pans 82 are in a desired or necessary position for optimal collection of any particles that remain trapped on screen 12 and that were not previously collected by vacuum assembly 70.

Ionizing or anti-static bars 84 and 86 are positioned along the upstream and downstream sides of screen 12 adjacent the outer surface of screen wall 14, and are spaced above collection pans 82. The ionization or anti-static bars 84 and 86 tend to ionize the particles remaining on screen 12 to substantially remove any electrostatic charges that would cause the particles to stay attached to screen wall 14. As a result, the particles are released from the screen wall and are allowed to drop downwardly for collection by collection pans 82.

One embodiment for using applicator apparatus 10 is shown in FIGS. 1 and 2. Substrate S is moved along a conveyor or table 90 (FIG. 2) in the direction of arrow 11, underneath screen 12. Screen 12 includes a screen wall 14 with a series of perforations or openings 16, which can be formed or arranged in a desired pattern or design and which can correspond to a printed or embossed design or pattern formed on substrate S. As substrate S passes beneath screen 12, screen 12 is rotated so that the perforation pattern is moved in timed sequence with the movement of substrate S. As screen 12 is rotated, feed system 20 deposits a supply of decorative particles P into the inner chamber 17 of the screen.

Alternatively, the blade, feeder, sheet configuration can be reversed within screen 12, so that screen 12 can rotate in the reverse direction and counter to the direction of movement of substrate S. Depending upon materials and patterns this may be advantageous in some cases.

The particles P generally are accumulated or collected on a flexible sheet 62 so that an accumulation or supply of particles is built up against an upstream edge of a blade 46 that engages and bears against screen wall 14. As the perforations in screen 12 pass beneath blade 46, the particles are urged through the perforations of screen 12 and onto substrate S. In this manner, a particular pattern of decorative particles is laid down on substrate S in register with one or more printed or embossed patterns on substrates.

EXAMPLE 2

Representative Surface Covering Prepared Using the Apparatus

The apparatus described herein, and particularly, the apparatus described in Example 1, is used to prepare a high end visual material. The first step involves calendering a filled PVC base to a thickness of about 30 mils. Using a pair of calendered rolls, the calendered base was pressed into a non-woven, flooring glass mat with a density of about 25 $g/m^2$ to partially saturate the glass. The total substrate thickness at this point is about 32 mils. Alternatively, the base can be directly applied to saturate the glass and the material then flipped over.

A foamable PVC plastisol was applied to the uncoated glass surface in a thickness of about 7 mils to totally encapsulate the glass mat, although other thicknesses can be applied. In this example, the plastisol was applied using a rotary screen coater, although other known coating techniques for applying plastisols can also be used. In some embodiments, non-foamable plastisols can also be used to saturate the glass. The plastisol was then gelled using radiant heaters, although heated drums or other suitable heating means can also be used.

In this example, a second foamable plastisol was applied to the first foam layer to a thickness of about 5 mils, although other thicknesses can be applied. In other examples (not shown), one relatively thick foamable layer was used instead of the two plastisol layers. The plastisol in this step was applied using rotary screen coaters, but other known techniques for applying plastisols can be used. This plastisol layer was then gelled using a heated drum, although radiant heaters or other heating means can also be used. The use of the heated drum created a smooth surface for printing.

A rotogravure printing was applied to the plastisol to create a design, where portions of the printing contain a chemical that retards expansion of the foam during the fusion cycle in those areas, resulting in chemical embossing. In this example, the chemical that retards expansion was applied in register with the design, although it need not be applied in this manner.

A clear PVC plastisol layer was applied to the print layer with an overall thickness of about 5 mils, although other thicknesses can be applied. The plastisol was applied using a rotary screen coater, but other known coating techniques for applying plastisols can alternatively be used. The plastisol acts as an adhesive for the particles/chips that are to be placed on top of the layer, and also protects the foamable plastisol and print layer during subsequent processing. The plastisol also acts as a key coat for a hot melt calendered (HMC) wear layer.

Using the apparatus described herein, in particular, the apparatus described in Example 1, particles/chips were deposited on the substrate in register with the pattern. Chips/particles were sieved through a 14 mesh screen: the particles that passed through a 14 mesh sieve were collected and used. The chips/particles were forced through a 10 mil thick rotary screen with patterned hole perforations of 2.5 mm in diameter. The chips were deposited in register with the printed pattern on the sheet. A registration system similar to that used on rotogravure presses was used to maintain the screens in register with the printed pattern. The screen did not contact the sheet. Although in this example, a single particle lay-up was performed, multiple particle lay-ups can also be performed, using the same or a different apparatus, but with different patterned screens.

The product face was then heated to a sufficient temperature to melt/fuse the particles. The temperature was about 300° F., although other temperatures can be used provided that they are sufficient to melt/fuse the particles but not high enough to adversely affect the product. The heating was performed using radiant heaters, although other suitable heating means could be used. After the product was heated, the product was then passed through a pair of rolls and smoothed. In this example, the top roll was a smooth chrome, and the bottom roll was rubber with a shore hardness of about 60 A. The material was wrapped around the chromed roll for approximately 9 seconds to set the chips/particles in a flattened state.

A PVC plastisol was then applied through a patterned rotary screen to create a decorative, raised element. The plastisol was registered to the rotogravure print and the particles. The plastisol was applied to the areas that include the previously deposited chips/particles, although it could also be added to the areas that do not include the chips/particles, or combinations thereof. The plastisol in this example, was transparent, although it can be transparent, translucent or pigmented. The composite was then passed through an air impingement oven where fusion and foam expansion of the plastisol layers occurred. The heating also allowed the flattened chips/particles to rebound. The fused, expanded substrate was then heated to a surface temperature of between about 280 and 290° F., using a radiant heater, although other suitable heating means could be used.

A clear, melt calendered PVC wearlayer was then applied to the substrate, as described in co-pending U.S. Ser. No. 09/200,813, filed on Nov. 27, 1998, now U.S. Pat. No. 6,649,248, the contents of which are hereby incorporated by reference. The calendered wearlayer flowed around the chips/particles and into the embossed areas of the product to maintain the product texture. Although the wearlayer was directly calendered in this example, it could also be applied as a film with heat. A high performance top coat layer, which in this embodiment was a UV-curable wearlayer, was applied to the product surface using either a soft durometer roll coater or airknife coater to maintain the product texture. The high performance top coat layer was then cured by exposure to UV irradiation. However, in other embodiments, the top coat layer is not UV curable, and need not be cured by exposure to UV irradiation. Additionally, the wear layer or wearlayer/top coat may also be mechanically embossed to enhance to change and enhance the product visual.

Figure 6:
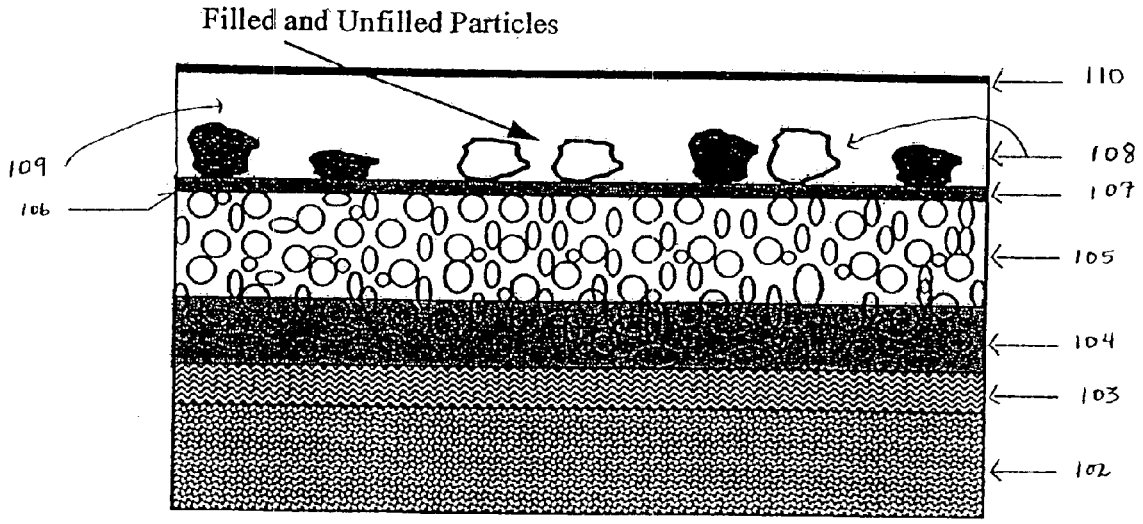
FIG. 6 is a cross sectional view of one embodiment of a substrate that can be prepared using the apparatus described herein.

The product structure described in this example is shown in FIG. 6. A layer of glass mat 103 overlies an HMC base 102. A foamable saturant layer 104 overlies and penetrates the glass mat layer 103. A top foam layer 105 overlies saturant layer 104. A rotogravure print layer 106 overlies foam layer 105. A plastisol barrier layer 107 overlies print layer 106. A layer of filled and unfilled particles 108 overlies the plastisol barrier layer 107. An HMC wearlayer 109 overlies the layer of filled and unfilled particles 108. A high performance coating 110 overlies the HMC wearlayer 109.

While the embodiments of the present invention which have been disclosed herein are the preferred forms, other embodiments of the present invention will suggest themselves to persons skilled in the art in view of this disclosure. Therefore, it will be understood that variations and modifications can be effected within the spirit and scope of the present invention and that the scope of the present invention should only be limited by the claims below. Furthermore, the equivalents of all means-or-step-plus-function elements in the claims below are intended to include any structure, material, or acts for performing the function as specifically claimed and as would be understood by persons skilled in the art of this disclosure, without suggesting that any of the structure, material, or acts are more obvious by virtue of their association with other elements.

What is claimed is:

1. An apparatus comprising:

a) rotary screen comprising a side wall defining an interior chamber, the side wall having a plurality of perforations for passing decorative components;

b) a blade extending proximate the rotary screen for directing the decorative components to pass through the perforations in the side wall;

c) a rotatable holding device; and d) a flexible sheet positioned within the interior chamber of the rotary screen so as to receive the decorative components on a side of the sheet opposite the side wall and deliver the decorative components to the rotary screen substantially along the blade, the sheet comprising a distal end portion which contacts the side wall near the blade forming a gap and a proximal end portion mounted to the rotatable holding device, whereby the size of the gap may be varied by rotating the holding device.

2. The apparatus of claim 1, further comprising a decorative component feeder system disposed within and extending substantially through the interior chamber of the rotary screen for distributing the decorative components substantially across the rotary screen.

3. The apparatus of claim 2, wherein the decorative component feeder system comprises:

a) a fed pipe having at least one opening;

b) a worm gear disposed within an extending substantially along the feed pipe; and c) a plurality of brush elements disposed along the worm gear.

4. The apparatus of claim 2, wherein the blade is mounted to the decorative component feeder system.

5. The apparatus of claim 1, and wherein the perforations formed in the side wall are formed in a predefined pattern for directing the decorative components to be placed onto a substrate in accordance with the predefined pattern.

6. The apparatus of claim 1, further comprising a decorative component removal system disposed within the interior chamber of the rotary screen.

7. The apparatus of claim 6, wherein the decorative component removal system comprises a manifold operably connected to a vacuum source comprising at least one opening for draining decorative components into the manifold.

8. An apparatus comprising:

a) a rotary screen comprising a side wall defining an interior chamber, the side wall having a plurality of perforations for passing decorative components;

b) a blade extending proximate the rotary screen for directing the decorative components to pass through the perforations in the side wall of the rotary screen;

c) a sheet positioned within the interior chamber of the rotary screen so as to receive and deliver the decorative components to the rotary screen substantially along the blade;

d) a feeder system disposed within and extending substantially through the interior chamber of the rotary screen for distributing the decorative components substantially across the rotary screen, wherein the feeder system comprises (i) a feed pipe having at least one opening, (ii) a worm gear disposed within and extending substantially along the feed pipe and (iii) a plurality of brush elements disposed along the worm gear; and e) a frame, the feed pipe being adjustably mounted to the frame.

9. An apparatus comprising:

a) a frame;

b) a rotary screen comprising a side wall defining an interior chamber, the side wall having a plurality of perforations for passing decorative components, the screen being mounted to the frame; and c) a flexible sheet disposed within the rotary screen so as to receive decorative components on a side of the sheet opposite the side wall and deliver the decorative components to the rotary screen, the sheet comprising a distal end portion which contacts the side wall and a proximal end portion mounted spaced from the side wall.

10. The apparatus of claim 9, further comprising a collection pan mounted adjacent the rotary screen in a position for catching excess decorative components from the rotary screen.

11. The apparatus of claim 9, further comprising a blade mounted within the rotary screen and having an edge adjacent the rotary screen.

12. The apparatus of claim 9, further comprising an ionization bar mounted adjacent the rotary screen for removing electrostatic charges from the decorative components, the ionization bar being adjacent the outer surface of the rotary screen.

13. An apparatus comprising:

a) a rotary screen comprising a side wall defining an interior chamber, the side wall having a plurality of perforations for passing decorative components;

b) a blade extending proximate the rotary screen for directing the decorative components to pass through the perforations in the side wall; and c) a decorative component removal system disposed within the interior chamber of the rotary screen wherein the decorative component removal system comprises a manifold operably connected to a vacuum source comprising at least one opening for drawing decorative components into the manifold.

14. An apparatus comprising:

a) a rotary screen comprising a side wall defining an interior chamber, the side wall having a plurality of perforations for passing decorative components;

b) a blade extending proximate the rotary screen for directing the decorative components to pass through the perforations in the side wall of the rotary screen; and c) a sheet positioned within the interior chamber of the rotary screen so as to receive and deliver the decorative components to the rotary screen substantially along the blade, wherein the sheet is flexible and is mounted to a mounting device, the mounting device being horizontally and vertically adjustable.

15. An apparatus comprising:

a) a rotary screen comprising a side wall defining an interior chamber, the side wall having a plurality of perforations for passing decorative components;

b) a blade extending proximate the rotary screen for directing the decorative components to pass through the perforations in the rotary screen;

c) an adjusting mechanism attached to the blade; and d) a frame, wherein the rotary screen and blade are mounted to the frame in such a manner that the blade is positioned within the interior chamber of the rotary screen so as to deliver decorative components through the perforations in the rotary screen, and wherein the adjusting mechanism permits the blade to pivot about a point off center of the rotary screen, whereby the blade moves into and out of engagement with the side wall.

* * * * *